US006890289B2

(12) United States Patent
Spinosa

(10) Patent No.: US 6,890,289 B2
(45) Date of Patent: May 10, 2005

(54) BACK-BOARD

(76) Inventor: Joseph Spinosa, 757 Terrace St., Honesdale, PA (US) 18431

( * ) Notice: Subject to any disclaimer, the term of this patent is extended or adjusted under 35 U.S.C. 154(b) by 0 days.

(21) Appl. No.: 10/272,400

(22) Filed: Oct. 17, 2002

(65) Prior Publication Data

US 2004/0077467 A1 Apr. 22, 2004

(51) Int. Cl.[7] ..... A63B 71/00

(52) U.S. Cl. ..... 482/140; 482/142; 482/148; 482/144; 482/145; 5/60; 5/507.1; 5/81.1; 128/25

(58) Field of Search ..... 482/140, 142, 482/148, 144–145

(56) References Cited

U.S. PATENT DOCUMENTS 3,826,490 A * 7/1974 Mossman ..... 482/94
4,515,361 A * 5/1985 Melillo et al. ..... 482/140
4,671,257 A * 6/1987 Kaiser et al. ..... 601/34
4,780,919 A * 11/1988 Harrison ..... 5/600
4,893,812 A * 1/1990 Dawson et al. ..... 482/94
4,925,184 A * 5/1990 McJunkin et al. ..... 482/60
5,106,083 A * 4/1992 Hall ..... 482/145
5,205,804 A * 4/1993 Hall ..... 482/141
5,417,636 A * 5/1995 Havens ..... 482/145
5,539,741 A * 7/1996 Barraclough et al. ..... 370/267
5,820,532 A * 10/1998 Oliver ..... 482/123
6,282,734 B1 * 9/2001 Holberg ..... 5/81.1 HS
6,321,398 B1 * 11/2001 Wang ..... 5/81.1 R
2002/0133878 A1 * 9/2002 O'Connell

* cited by examiner

*Primary Examiner*—Danton D. DeMille
*Assistant Examiner*—L. Amerson

(57) ABSTRACT

The device is designed to enable the user to perform both abdominal strengthening and back muscle strengthening exercises on the top of a conventional bed. A conventional bed is defined as one with a semi-rigid mattress and a rigid frame.

The device attaches and detaches to the described bed easily and provides the means to strengthen both flexor and extensor muscles of the trunk with the dual advantages of maximum convenience and minimum cost.

The device is a departure from the previous art in that it enables the user to strengthen the trunk muscles at home without the necessity of cumbersome and expensive equipment.

1 Claim, 4 Drawing Sheets

BACK-BOARD

CROSS REFERENCE TO RELATED APPLICATIONS

| | | | | |
|---|---|---|---|---|
| 1. | 5106083 | Dec. 10, 1990 | Hall | 482/145 |
| 2. | 4830367 | May 16, 1989 | Foran | 482/140 |
| 3. | 4609193 | Sep. 2, 1986 | Paris | 482/144 |
| 4. | 4522391 | Jun. 11, 1985 | Rundall | 482/40 |
| 5. | 4182511 | Jan. 8, 1980 | Camp | 482/142 |
| 6. | 6231923 | Apr. 10, 2001 | Cameron | 482/142 |
| 7. | 5776042 | Jul. 7, 1998 | Szabo | 482/140 |
| 8. | 5871425 | Feb. 16, 1999 | Gvoich | 482/140 |
| 9. | 6213923 | Mar. 1, 1999 | Cameron | 482/142 |
| 10. | 5492520 | Feb. 1, 1996 | Brown | 482/142 |
| 11. | 5725463 | Mar. 1, 1998 | Colonello | 482/140 |
| 12. | 5776042 | Jul. 7, 1998 | Szabo | 482/140 |
| 13. | 1705745 | Mar. 1, 1929 | Anderson | 482/133 |
| 14. | 4893813 | Jan. 16, 1990 | Murray | 482/145 |
| 15. | 5256126 | Oct. 1, 1993 | Grotstein | 482/133 |
| 16. | 5346447 | Sep. 1, 1994 | Stearns | 482/140 |
| 17. | 5441473 | Aug. 1, 1995 | Safani | 482/140 |
| 18. | 4319747 | Mar. 1, 1982 | Rogers | 482/145 |

BACKROUND OF THE INVENTION

Acute low back problems are experienced by a large percentage of the adult population in the United States. The costs in terms of medical treatment, time lost from work, and disruption of normal activities are significant. The invention is offered as a means to prevent acute low back pain as defined by, activity intolerance of less than three months duration in the absence of serious spinal pathology. The invention provides the means to strengthen the trunk muscles in the home setting at low cost and maximum convenience.

According to the U.S. Department of Health and Human Services, "Conditioning exercises for the trunk muscles (particularly the back extensors) may be helpful, especially if the patient's acute low back problems persist." The latter quote is found on page 3 of the AHCPR (Agency for Health Care Policy and Research) publication No. 95-0642 December 1994.

Exercise devices for trunk strengthening have been offered in the past, but they tend to be expensive and inconvient to use at home. Since trunk strengthening must be done regularly throughout the active years of the life span, the methodology must maximize efficiency and convenience.

BRIEF SUMMARY OF THE INVENTION

The invention consists of a rectangular board and a freestanding removable clamp. The invention is designed to be used with a conventional bed. By conventional bed, it is meant, a bed consisting of a rigid frame and semi-rigid mattress.

Together, the invention and bed become a trunk strengthening device. The rectangular board is placed on top of the mattress and becomes the platform from which the exercises are performed. The clamp secures the board to the bed so that it can not move during the exercises. The board and clamp are easily assembled and disassembled and require minimal space for storage when not in use.

The post 1 is located on the base 2 in a position such that forces toward the user and away from the bed are counteracted.

Figure 2:
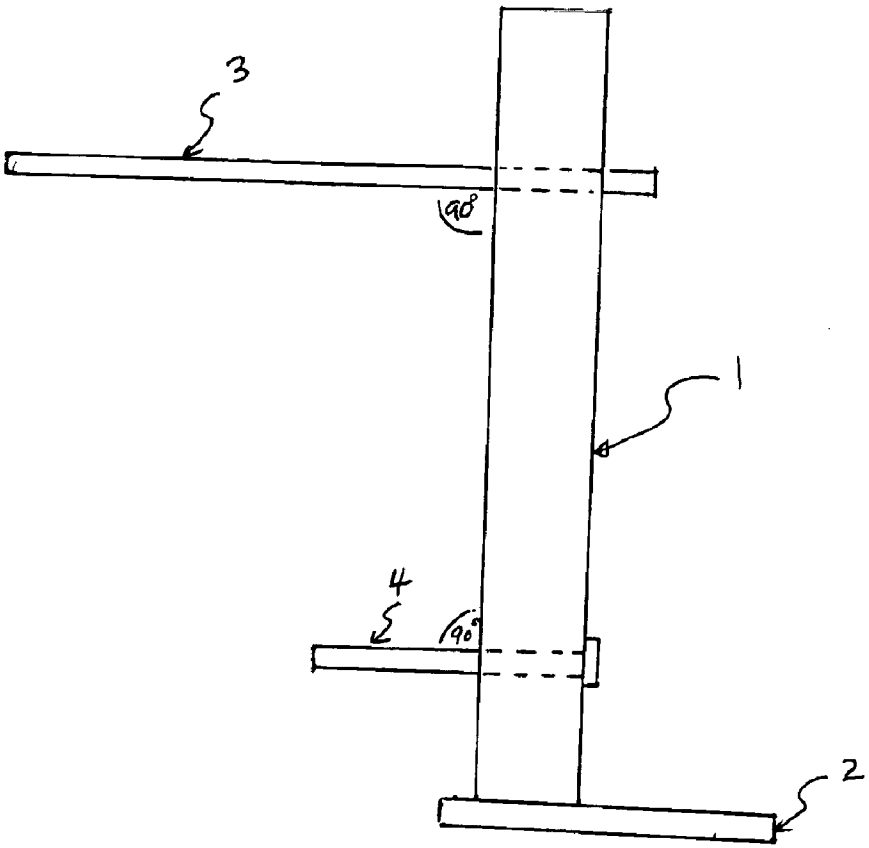
Figure 1:
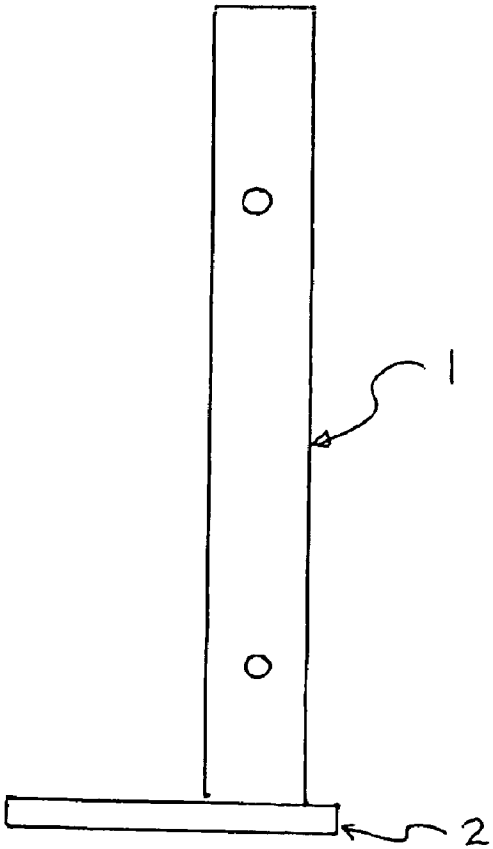
FIG. 1 is and end view of the //freestanding clamp// supporting post consisting of post 1 and rectangular base 2.

FIG. 2 is a front to back view of the //freestanding clamp// supporting post. The upper rod 3 and the lower rod 4 are shown as they are positioned in the post 1. Both rods are at a 90 degree angle to the post and they are positioned within the post such that the angle can not change.

Figure 3:
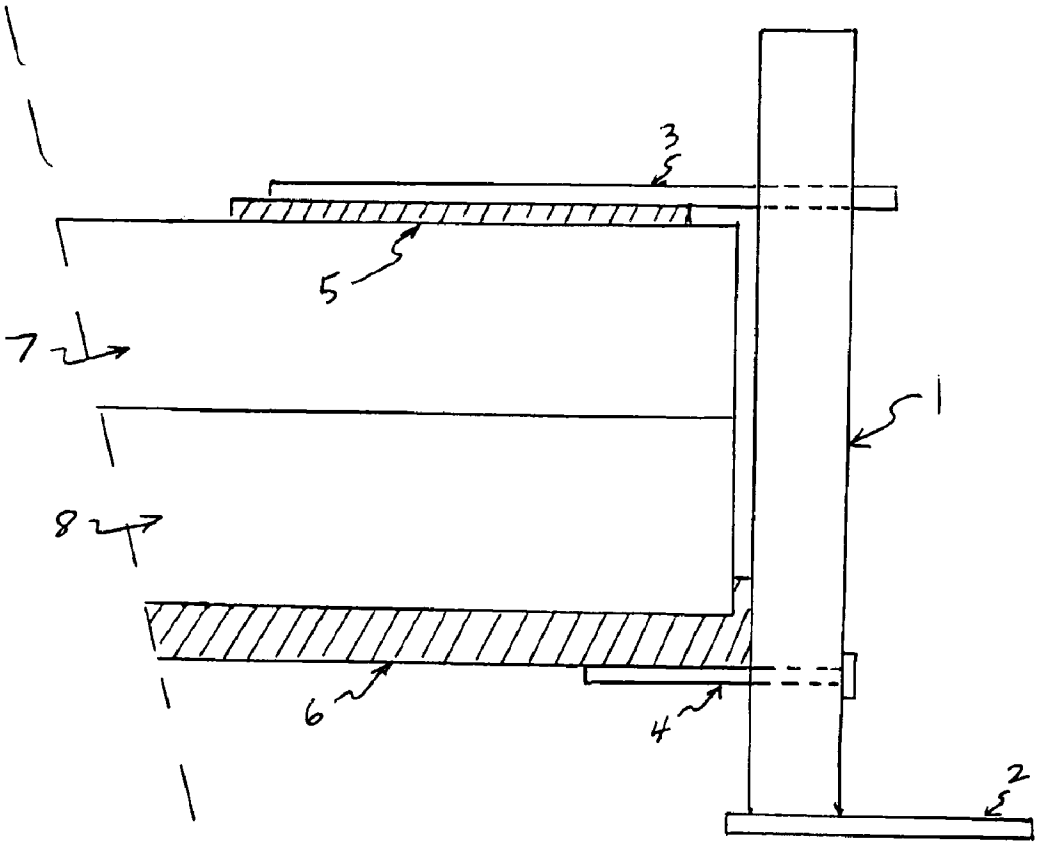

FIG. 3 is a view from the end of the bed looking toward the head of the bed. FIG. 3 shows the board 5 and //clamp// supporting post in position for use. FIG. 3 shows the lower rod 4 pressing up against the bed frame 6 and the upper rod 3 pressing down against the board 5. The mattress 7 and box spring 8 of the bed are indicated.

Figure 4:
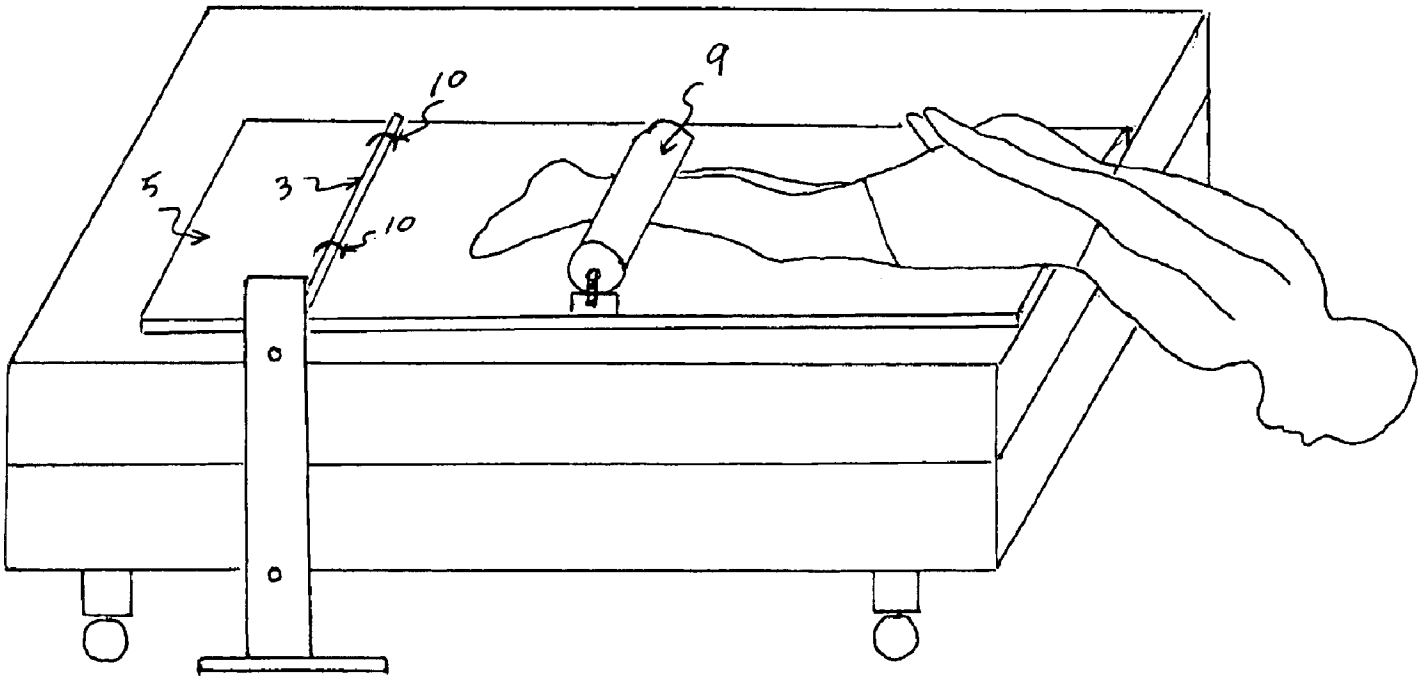

FIG. 4 shows the user in a prone position with the upper body flexed forward over the edge of the bed. The user's ankles are positioned under the foam covered bar 9. FIG. 4 shows the upper rod 3 within the guide //clamps// strays 10 that are mounted on the board 5.

Figure 5:
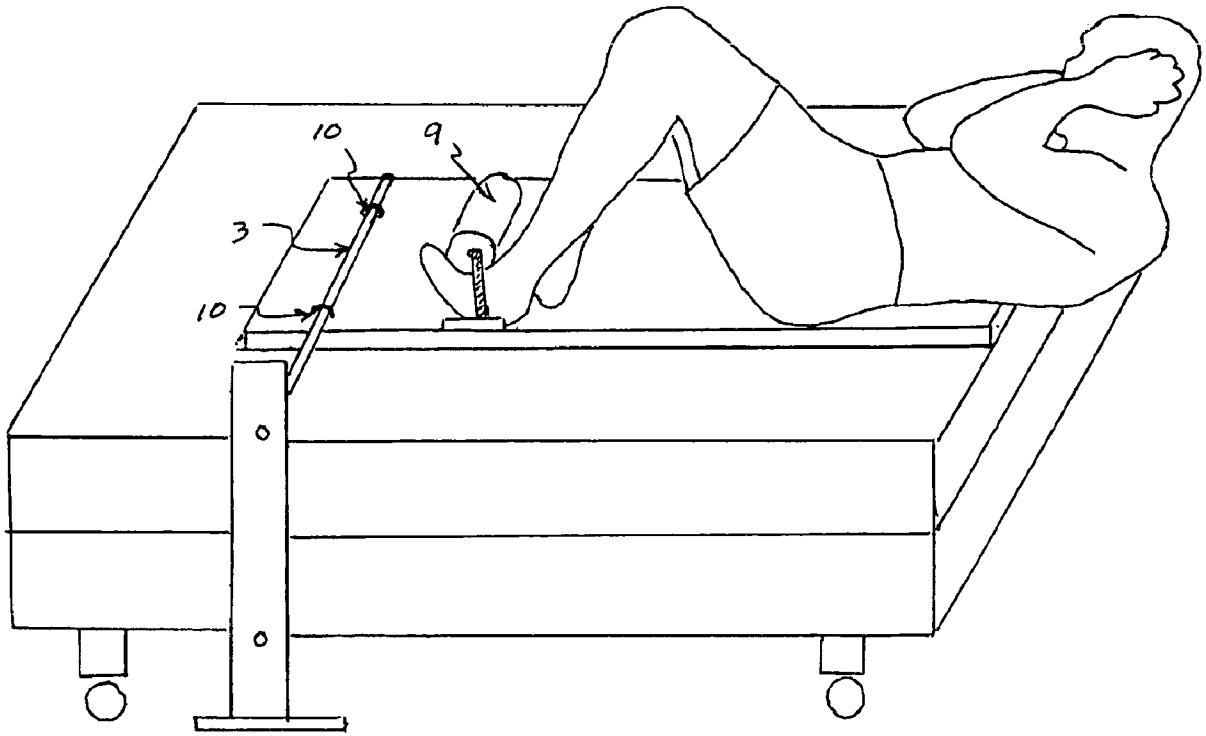

FIG. 5 shows the user in the supine position with the ankles under the foam covered bar 9. The upper rod 3 is within the guide //clamps//straps 10.

DETAILED DESCRIPTION OF THE INVENTION

The invention consists of a rectangular board, and //a free standing adjustable clamp// an attachable supporting post. The board, which is rigid and lightweight, has at one end a foam covered bar meant for the stabilization of the lower extremities. The bar can be positioned at various points on the board in order to accommodate users of various height.

//The clamp consists of an upright post which// The supporting post is mounted on a rectangular base for stability. Two metal rods pass through the post. The bottom rod is shorter and it passes under the bed frame. The longer rod passes over the board through two guide //clamps// straps that are mounted on the board and then through the upper portion of the post. Various holes are located in the post for both rods in order to achieve sufficient compression between the board, the mattress, and the bed frame.

The board is positioned with its top edge in line with the bottom end of the mattress. The board is then //clamped to the bed// attached to the post. To perform abdominal exercise, the user lies on the board in the supine position with hips and knees flexed and feet under the bar. Sit ups and abdominal curls are performed in the usual manner.

To perform back strengthening exercise, the user lies in a prone position on top of the board with the waist at the edge of the board and the bed. The ankles are positioned under the foam covered bar. The user allows the upper body to flex forward over the edge of the bed. Back strengthening is accomplished by returning the upper body to the horizontal position from the downward flexed position. Back muscle strengthening is achieved by repeating the cycle of flexed and extended positions until muscle fatigue of the trunk is reached.

What I claim as my invention is:

1. An exercise device attached to a conventional bed for exercising the trunk flexor and trunk extensor muscles, said device essentially consisting of:

A first and second attachable part, said first part including a rigid rectangular board with a first and second end and designed and configured to support the lower trunk of a user; said board positioned on a top surface of said bed;

Said second part including a vertically adjustable free-standing upright support post mounted on said board for stabilizing and aligning said board to said bed in a horizontal and vertical direction;

Said first end of said board having a detachable foam covered bar for stabilizing the lower extremities of a user; said foam covered bar being vertically adjustable relative to said board;

Said board having mounted thereon two removable guide clamps;

Said supporting post further having a rectangular base and two sets of apertures for each of two metal rods; said rods being an upper rod and a bottom rod which pass through said apertures; said bottom rod defined by a shorter length than said upper rod; said bottom rod extending horizontally underneath said bed while said upper rod extending horizontally over a top surface of said rectangular board and through said guide clamps.

* * * * *